US005399299A

United States Patent [19]

Stengel et al.

[11] Patent Number: 5,399,299

[45] Date of Patent: Mar. 21, 1995

[54] HUMIDIFIER

[75] Inventors: Ed Stengel; Hans Heidolph, both of Wiarton, Canada

[73] Assignee: Caframo Ltd., Wiarton, Canada

[21] Appl. No.: 66,879

[22] Filed: May 13, 1993

[30] Foreign Application Priority Data

May 29, 1992 [CA] Canada ..... 2070030

[51] Int. Cl.[6] ..... B01F 3/04

[52] U.S. Cl. ..... 261/030; 261/99; 261/104; 261/120

[58] Field of Search ..... 261/120, 30, 99, 104, 261/107; 55/234

[56] References Cited

U.S. PATENT DOCUMENTS

| | | | |
|---|---|---|---|
| 2,494,640 | 1/1950 | Abott | 261/104 |
| 3,497,185 | 2/1970 | Dively | 261/120 |
| 3,864,437 | 2/1975 | Blaszkowski | 261/24 |
| 3,954,920 | 5/1976 | Heath | 261/104 |
| 4,009,675 | 3/1977 | Zollen et al. | 114/267 |
| 4,216,091 | 8/1980 | Mineau | 261/120 |
| 4,448,593 | 5/1984 | Spiers | 261/120 |
| 4,679,522 | 7/1987 | Nishida | 114/357 |
| 4,698,188 | 10/1987 | Gutmann | 261/120 |
| 4,822,533 | 4/1989 | Steiner et al. | 261/120 |
| 4,865,755 | 9/1989 | Steiner et al. | 261/120 |
| 4,906,359 | 3/1990 | Cox, Jr. | 261/120 |
| 5,073,307 | 12/1991 | Langer et al. | 261/35 |
| 5,133,904 | 7/1992 | Pepper | 261/24 |
| 5,143,655 | 9/1992 | Chiu et al. | 261/107 |

FOREIGN PATENT DOCUMENTS 3312367 10/1984 Germany .

*Primary Examiner*—Khanh Nguyen
*Attorney, Agent, or Firm*—Marks & Clerk

[57] ABSTRACT

A humidifier comprises a container having an air inlet and an air outlet; a water reservoir in the container; an absorbent mass having extensive upper surface and lower surfaces, the absorbent mass being floatable on the surface of water in the reservoir; a plate disposed on the lower surface of the absorbent mass to limit the degree of immersion of the absorbent mass while it floats in the reservoir; and a blower for drawing air through the air inlet and directing it onto the upper surface of the absorbent mass so that the air can deposit particles thereon, and absorb moisture therefrom, prior to flowing out of the container through the air outlet. The humidifier is highly efficient, quiet in operation and not affected by varying water levels.

6 Claims, 1 Drawing Sheet

HUMIDIFIER

BACKGROUND OF THE INVENTION

This invention relates to a humidifier, and more particularly a humidifier for humidifying air in a closed environment, such as the room of a building.

In cold climates it is generally necessary to humidify the air in buildings because the moisture content of cold air is very low. When the air is heated to room temperature, the relative humidity, which is a measure of the actual moisture content relative to the moisture-bearing capacity of the air, is so low that human discomfort is experienced.

There have been many different kinds of humidifier on the market for some years. A common type of humidifier consists of a rotating drum partially immersed in a trough of water, the drum carrying a belt through which air to be moisturized is passed. Such humidifiers are relatively clumsy and suffer from the disadvantage that the porous belt mounted on the drum tends to become clogged with calcium deposits.

German Patent No. 3,312,367 describes a humidifier where air is blown onto an evaporator held by one or more floats on the surface of a water reservoir. A portion of the evaporator, which may be made of paper, extends into the water and keeps the evaporator moist by capillary action.

While representing an improvement over the prior art, this humidifier is limited in its capacity to draw water into the evaporator due to the limited contact with the water reservoir. Also, the evaporator has limited or no ability to remove dust particles carried by the air stream.

An object of the present invention is to provide an improved humidifier alleviating the problems of the prior art.

SUMMARY OF THE INVENTION

According to the present invention there is provided a humidifier comprising: a container having air inlet means and air outlet means; a water reservoir in said container; a highly absorbent spongy mass having extensive upper surface and lower surfaces, said absorbent mass being floatable on the surface of water in said reservoir; floating plate means disposed under said lower surface to limit the degree of immersion of said absorbent mass so that it remains partially submerged while floating in said reservoir with said lower surface fully immersed therein; and blower means for drawing air through said air inlet means and directing said air onto the exposed upper surface of said absorbent mass so that said air strikes said exposed upper surface to deposit particles thereon and absorb moisture therefrom prior to flowing out of said container through said air outlet means.

The incoming air stream is preferably perpendicular to the surface of the absorbent mass so that maximum deflection occurs and the trapping of airborne particles by the absorbent mass is maximized. To further increase its surface area the absorbent mass can have an undulating pattern, such as a triangular or saw-tooth pattern on its upper surface. It should be noted that the triangular peaks are formed from a solid mass of sponge, which ensures a plentiful supply of water onto the exposed surfaces from within the body of the triangular peaks.

The humidifier may comprise a generally rectangular container with an aperture in the top surface containing a primary filter and opposed apertures in the side walls forming the outlet means through which air is discharged after striking the floating absorbent mass.

The highly absorbent mass, which is preferably a commercial loose cellulose sponge, such as O-Cel-O TM sponge, tends to become waterlogged such that without support it would become almost wholly submerged and thus have a limited surface area exposed above the water. The floating support, which is preferably in the form of a flat plate of high density foam such as STYROFOAM TM, for example ETHAFOAM TM from Dow Chemical Co., is normally wholly submerged in the water reservoir. This plate supports the absorbent mass to limit the degree to which it becomes submerged along with the plate. This arrangement maximizes the capillary flow into the exposed portions of the absorbent mass that are struck by the incoming air stream and the surface area of the exposed mass.

The absorbent mass preferably comprises two identical pieces of highly absorbent, low-density foam, located side by side and resting on the supporting plate.

The two pieces of foam, which do not need to be attached to the supporting plate, can be easily removed and hand-washed for cleaning, and then reused rather than being thrown away and replaced.

A humidifier according to the invention can use approximately 10 percent of the power required by, for example, conventional steaming humidifier currently on the market. Since the only moving part is the fan motor, the humidifier can operate at low sound levels.

BRIEF DESCRIPTION OF THE DRAWINGS

The invention will now be described in more detail, by way of example only, with reference to the accompanying drawings, in which.

DESCRIPTION OF THE PREFERRED EMBODIMENTS

Figure 1:
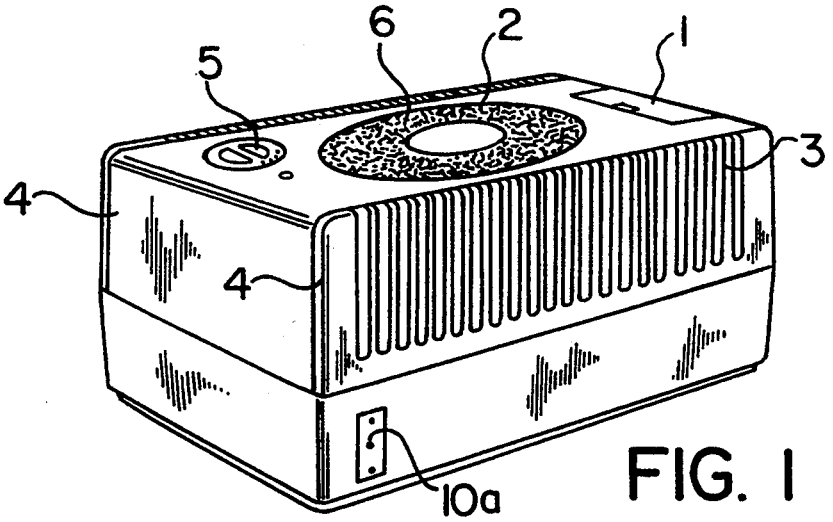
FIG. 1 is a front perspective view of a humidifier in accordance with the invention.
Figure 2:
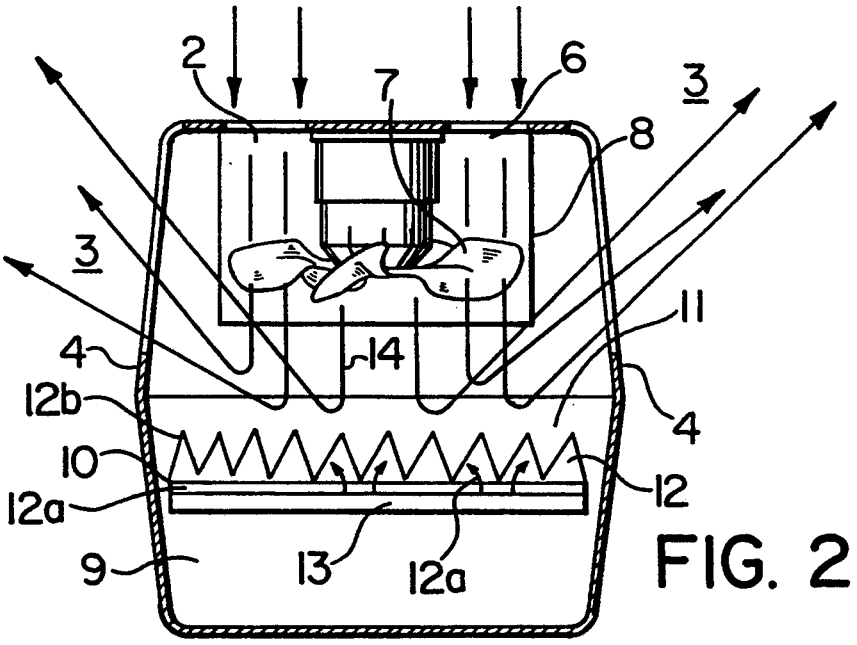
FIG. 2 is a cross-sectional view of the humidifier shown in FIG. 1.

Referring now to the drawings, the humidifier comprises a generally rectangular container 1 with an annular aperture 2 in its top surface forming an air intake and a pair of outlet grills 3 in opposed side walls 4 for the discharge of air flowing through the humidifier. A control switch 5 permits the humidifier to be set at the desired level of operation.

A generally toroidal primary filter 6 is located in the annular intake 2 to remove coarser particles from dust-laden intake air. The primary filter 6 can be made of any suitable low-resistance commercial filter material. A fan 7, controlled by switch 5, is located in the container 1 beneath the air intake 2 and surrounded by a duct 8 to confine the air flow through the fan 7.

Figure 3:
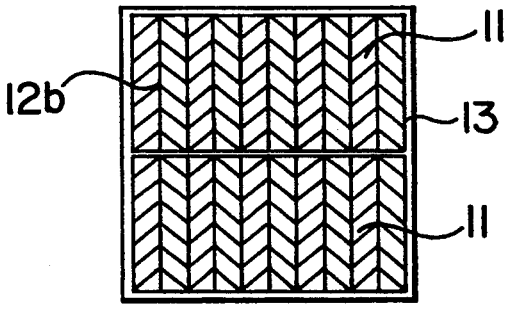
FIG. 3 is a plan view of a humidifier element.

The lower part of the container 1 provides a water reservoir 9 having a water surface 10, the level of which is indicated by an indicator **10*a*. A humidifier element 11 (FIG. 3) comprising two sheets of highly absorbent, low-density foam 12 attached to a high density STYROFOAM TM plate 13, floats from the surface 10 of the water and the reservoir 9. The foam 12 has an upper surface with generally triangular solid protrusions 12*b***.

The plate 13 ensures that the foam 12 floats on the water in the reservoir 9 such that a minimal portion 12*a* having a depth D remains submerged at all times. The foam 12 thus acts like a partially submerged sponge, and at all times water can flow freely by capillary action into protrusions 12*b*, which remain saturated regardless of the water level 10 in the reservoir 9. The highly absorbent nature of the sponge and the fact that it is prevented from becoming too deeply submerged by the supporting plate 13 optimize the wetness of the exposed surface 12*b* at all times. Arrows 12*c* show water flowing by capillary action through the solid protrusions 12*b* within the body of the sponge.

Air from the inlet 2 is blown directly by the fan 7 onto the upper surface of the foam 12, the incoming air stream being generally perpendicular to the plane of the foam 12. The incoming air 14 strikes the corrugated upper surface 12*b* and is deflected outward at an angle through outlet grilles 3. Upon striking the upper surface 12*b* of foam 12, the incoming air picks up moisture and at the same time, in the process of being deflected, deposits particulate matter on the moist and absorbent foam. The particles carried by the air stream tend to become attached to the absorbent foam rather than being deflected like the air.

This system is highly efficient at moisturizing the air and removing airborne particular matter. The system automatically adjusts to changing water levels such that the effectiveness of humidification remains constant for all levels. No complicated flow valves are necessary in order to maintain a constant water level in the humidifier reservoir. After a certain period of time, the two sections of foam can easily be removed and hand washed for cleaning prior to reuse rather than being discarded as was generally the case with prior art humidifiers.

The humidifier is particularly quiet in operation since the only moving part is the electric motor driving fan 7, and generally the humidifier will use about 10% of the amount of power required to operate a conventional steaming humidifier, for example.

We claim:

1. A humidifier comprising:

a) a container having air inlet means and air outlet means, and defining a water reservoir therein;

b) a humidifier element floatable on the surface of water in said reservoir having extensive upper and lower surfaces;

c) blower means for drawing air through said air inlet means and directing a stream of air onto said upper surface of said humidifier element such that it strikes said upper surface and is deflected thereoff toward said air outlet means; and d) said humidifier element comprising:

(i) a generally solid block of low density spongy foam material having a main body portion and an undulating upper surface forming said extensive upper surface of said humidifier element; and (ii) a submerged floating plate supporting said block of low density foam such that when said humidifier element floats in said reservoir said block of low density foam remains partially submerged with said undulating upper surface thereof substantially fully exposed to said stream of air directed thereon whereby entrained particles in said stream of air are deposited on, and moisture is absorbed from, said undulating upper surface of said block as said stream of air is deflected thereoff.

2. A humidifier as claimed in claim 1, wherein said block of low density foam comprises at least one sheet of loose cellulose foam.

3. A humidifier as claimed in claim 1, wherein said undulating upper surface is of saw-tooth shape and forms solid triangular protrusions.

4. A humidifier as claimed in claim 1, further comprising a primary filter in said air inlet means to remove coarse particles from the inflowing air.

5. A humidifier as claimed in claim 4, wherein said primary filter is of toroidal shape.

6. A humidifier as claimed in claim 1 wherein said air outlet means comprise opposed apertures located on opposite side of said container.

* * * * *